United States Patent [19]

Stepp

[11] Patent Number: 5,044,247

[45] Date of Patent: Sep. 3, 1991

[54] STRING TENSION ADJUSTING MECHANISM FOR A STEEL GUITAR

[76] Inventor: Charles F. Stepp, 2125 Dixie Hwy., Louisville, Ky. 40210

[21] Appl. No.: 516,042

[22] Filed: Apr. 27, 1990

[51] Int. Cl.[5] ..... G10D 3/14

[52] U.S. Cl. ..... 84/312 P

[58] Field of Search ..... 84/312 P, 297 R, 299, 84/313, 205-208, 312 R, 307, 298

[56] References Cited

U.S. PATENT DOCUMENTS

| | | | |
|---|---|---|---|
| 2,973,682 | 3/1961 | Fender | 84/312 P |
| 3,014,395 | 12/1961 | Blair | 84/312 P |
| 3,352,188 | 11/1978 | Fender | 84/312 P |
| 4,080,864 | 3/1978 | Jackson | 84/312 P |
| 4,157,050 | 6/1979 | Lashley | 84/312 P |
| 4,175,467 | 11/1979 | Lashley | 84/312 P |
| 4,342,249 | 8/1982 | McCormick et al. | 84/312 P |

FOREIGN PATENT DOCUMENTS 2035651 6/1980 United Kingdom .

*Primary Examiner*—Brian W. Brown
*Attorney, Agent, or Firm*—William R. Price

[57] ABSTRACT

A string tension adjusting mechanism for a steel guitar. The adjusting mechanism consists of three basic parts, a bridge member, over which a guitar string is mounted and to which tension is applied to a desired pitch. A raising lever member, actuated by a pull rod, turns the pivotably-mounted bridge member clockwise to increase the tension and incease the pitch. A lowering lever member, again actuated by a pull rod, causes the bridge member to pivot in a counterclockwise direction, thus relieving the tension on the string and lowering the pitch. One of the lever members is attached to the bridge member, while both of the lever members are pivoted together. One of the lever members contains a large hole and a spacing device is mounted therein, at the point of pivot, to maintain a free space between the two lever members and between the lever member and the bridge. This allows for free and easy raising or lowering of the pitch of a particular string while the guitar is being played and minimizes drag and friction. Maintaining a free space between the lever members and between the lever members and the bridge member produces a pure tone quality. The tone quality is further enhanced by the provision of a large V-shaped notch in the leading edge of the lowering lever.

7 Claims, 2 Drawing Sheets

STRING TENSION ADJUSTING MECHANISM FOR A STEEL GUITAR

FIELD OF THE INVENTION

The invention relates to an improved pitch changing means in the form of a string tension adjusting mechanism for a steel guitar. The string tension adjusting mechanism is actuated by a pedal attached to a lever for raising or lowering the pitch from the normal or tuned pitch.

DESCRIPTION OF THE PRIOR ART

Applicant is aware of the following prior art:

| Pat. No. | INVENTOR | DATE |
|---|---|---|
| 4,157,050 | Lashley | 1979 |
| 4,175,467 | Lashley | 1979 |
| 4,342,249 | McCormick, et al | 1982 |
| 3,014,395 | Blair | 1961 |
| 3,352,188 | Fender | 1967 |
| 4,080,864 | Jackson | 1978 |
| 2,973,682 | Fender | 1961 |
| UK Patent Application 2,035,651A | McCann | 1980 |

Pedal steel guitars are commonly tuned by adjusting the tension on the strings without the foot pedals being depressed. After the strings have been tuned to a desired pitch in the open condition (without depression of the pedals), the pedals can be actuated to produce a certain note for the responsive string, which is different from that obtained in the open condition. The term "pedal," as used herein, refers to knee, hand, foot or other lever-operated pedals for obtaining tone variation in either a higher or lower tone from the pitch of the tuned, open condition of the string.

SUMMARY OF THE INVENTION

The invention consists of a string-mounting apparatus and a string tension-adjusting mechanism for a pedal guitar, commonly known as a steel guitar. The string is tuned in the open condition by adjusting the tuning screw with the locking mechanism disengaged. When the string has been properly tuned in the open condition, the locking mechanism is engaged. The string is then tightly secured to the neck nut, to prevent it from loosening or tightening during stress: the opposite end of the string having been attached to the attachment pin, so that pivoting of the bridge member on its axle in one direction increases the tension on the string, thus raising the pitch. Pivoting of the bridge member in the opposite direction decreases the tension on this string and thus lowers the tone. A spacer member is mounted in a large hole in one of the levers. Additionally, the spacer member maintains a free space between the levers and between both levers and the bridge member. Only one lever is directly attached to the bridge member. Only one lever is attached to a biasing spring. The two lever members, however, are pivoted together at the top so one can move independently of the other. Additionally, a large, V-shaped notch is placed in the body of one of the lever members and this enhances the pure tonal qualities of the vibrational characteristics of the string. The spacer member also eliminates drag and allows for free and easy actuation of the pedals, movement of the raising and lowering levers and pivoting rotation of the bridge on its axle in a counterclockwise or clockwise direction, without friction or drag.

BRIEF DESCRIPTION OF THE DRAWINGS

in FIG. 5, the mechanism in raising position: and in FIG. 6, the mechanism in lowering position.

DESCRIPTION OF THE PREFERRED EMBODIMENT

Figure 1:
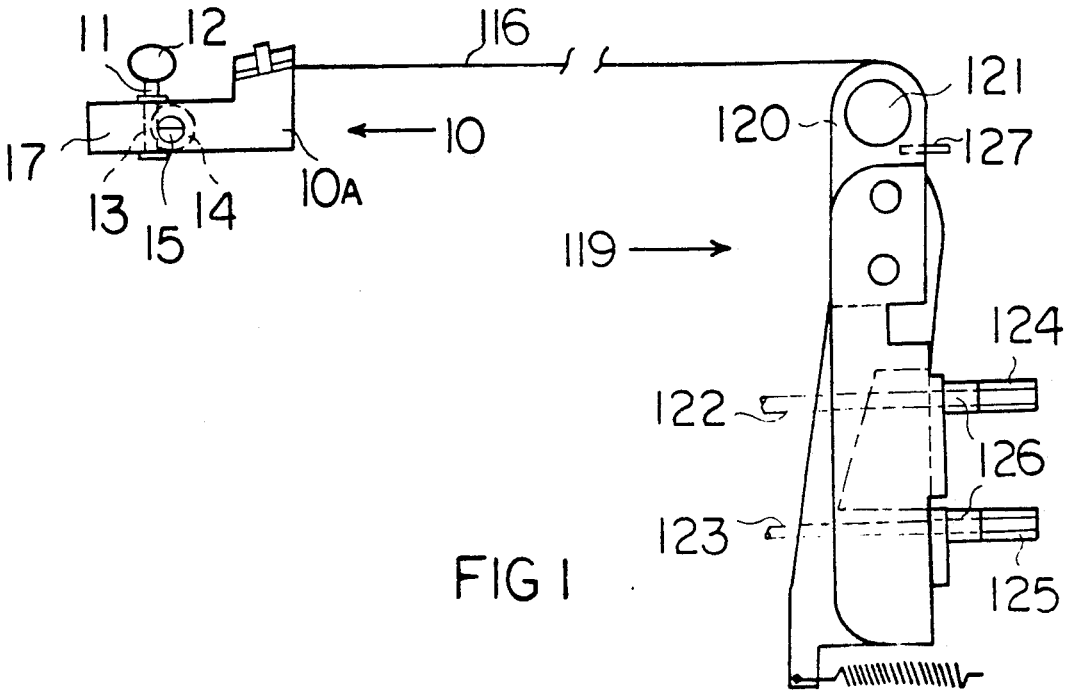
FIG. 1 is a side elevational view, partially diagrammatic, illustrating a string tension adjusting mechanism for a steel guitar.

Turning now to the drawings, FIG. 1 demonstrates the string tension adjusting mechanism of the present invention for musical instruments, such as a pedal guitar. Such guitars have one or two necks, and each neck will contain up to ten strings. Each string involves a separate string tension adjusting mechanism so that the total number of such mechanisms would equal twenty on a double-neck guitar. For simplicity of illustration, however, only a single string is illustrated in operative relationship with the appropriate neck portion and the appropriate part of the string-adjusting mechanism.

Referring to FIG. 1, the neck nut means 10 has a base member 10-A, having a turning screw 11 with a head 12 and threads 13, which cooperatively react with worm gear 14 and rotate around its axle post 15. The terminal end of the guitar string 16 is wrapped around axle post 15. The tuning screw 11 and worm gear 14 comprises the string tuning adjusting means 17, which can be used to tighten or loosen string 16 when hold down member 18 is disengaged from spring 16. As shown in FIG. 1, hold down member 18 consists of a set screw which may be replaced with a thumb screw or other means to function as a lock down string 16, once it is properly tuned to the open condition by adjusting means 17. Connected to the opposite end of the string 16 is tone or string tension adjusting means 119, which is shown in the assembled condition in FIG. 1. The string securing bridge 120 can rotate clockwise or counterclockwise around axle 121 to raise or lower the tone of string 16.

For purposes of illustration, the string tension adjusting mechanisms are shown in the reversed position in FIGS. 4, 5, 6, 7, 8 and 9, so that the clockwise or counterclockwise description has no significance except as viewed from the drawings.

Figure 2:
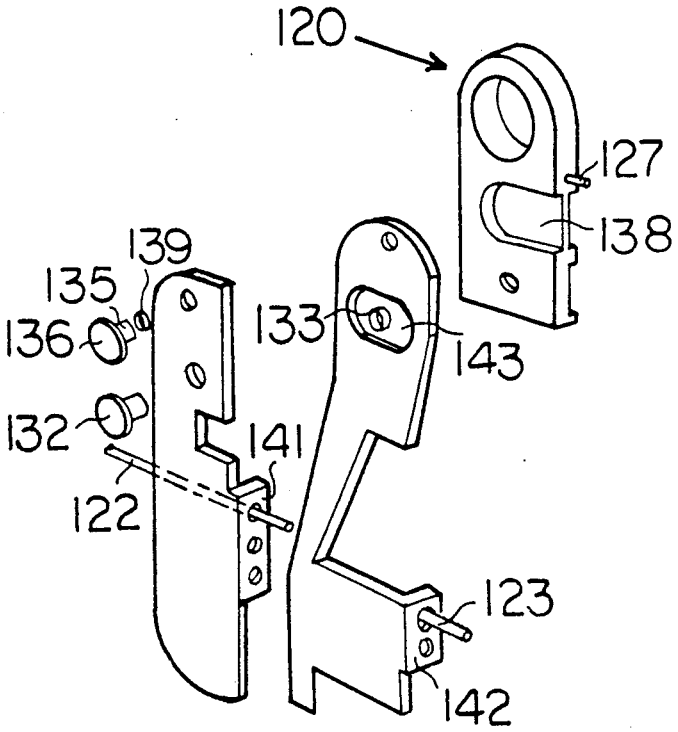
FIG. 2 illustrates a rear elevational view of the string tension adjusting mechanism of this invention.
Figure 3:
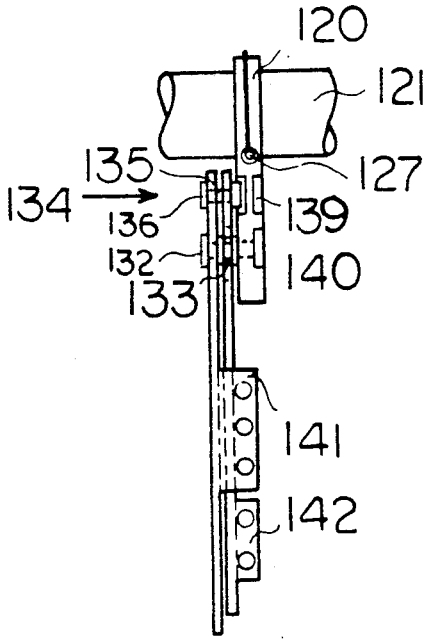
FIG. 3 demonstrates the string tension adjusting mechanism in exploded fashion.

When viewing the apparatus and string adjusting mechanism, as is illustrated in FIGS. 1, 2 and 3, on Page 1, the string securing bridge member 120 is shown to be pivotably mounted on string securing bridge axle 121, so that the bridge member 120 can rotate clockwise or counterclockwise around axle 121 to raise or lower the tone of string 116. The depression of the pedal (not shown) which is connected to raising rod 122 urges string securing bridge member 120 in a clockwise direction, whereas depression of the pedal (not shown) connected to lowering rod 123, causes string securing bridge member 120 to rotate in a counterclockwise direction, thus lowering the tone of string 116. Both rods 122 and 123 are of the pull variety so that the raising and lowering levers 130 and 131 are actuated by pulling and not pushing. Raising rod 122 has an adjusting cap 124 and lowering rod 123 has an adjusting cap 125, each of which are threaded and which are used by the musician to tune string 116 further after it has been tuned in its "free" or open position. Additionally, spacer means 126 are also shown for rods 122 and 123. The string tension adjustment member 119 comprises a bridge member 120, mounted on axle 121. The raising rod 122, attached to pedals (not shown), pulls the raising lever member 131, in attachment with bracket 141. The lowering rod 123, similarly pulls upon depression of the pedal (not shown) and is attached to bracket 142 for the lowering lever member 130. The lowering lever member 130 and the raising lever member 131 pivot point 134.

Rivet 135, has a head 136 and a washer 137. It will be noted that the spacer 133 fits over the shaft of rivet 132 and is located in assembled condition in the large elliptical hole 143 in the lowering member 130. The shaft of the rivet 132 extends through bridge member 120, so that the raising member 131 is pivotably connected to the bridge member 120. Lowering member 130, however, is not physically attached to the bridge member, but engages when the spacer member 133 reaches the terminal ends of the elliptical hole 143 during the excursion of the lowering member bracket 131.

The raising lever member 131 and the lowering lever member 130 are pivoted together at point 134 via rivet 135, having a rivet head 136. The washer 137 fits around the shaft of the rivet 135, allowing for easy movement of the raising member 131, relative to lowering member 130.

As will be noted, the spacer 133, fitting in the elliptical hole 143 of the lowering member 130, has a greater thickness than the thickness of the lowering member 130. As is best shown in FIG. 2, the spacer member 133 defines a free space between the depending legs of the raising lever member 131 and the depending leg of the lowering lever member 130 and additionally maintains free space between the upper portion of the lowering member 130 and the lower portion of the bridge member 120. Additionally, the flattened-out portion of the rivet 135 on the outside surface of lowering lever member 130 fits into a groove 138 so as not to engage the bridge member 120. The attachment pin 127 is for the terminal portion of the string 116 and increases the tension thereon and thus the tone when the bridge member 120 pivots in one direction around bridge axle 121. Additionally, when the bridge member 120 pivots in the opposite direction around axle 121, the pin 127 moves in the opposite direction, thus decreasing the tension on the string 116 and lowering the tone.

Figure 4:
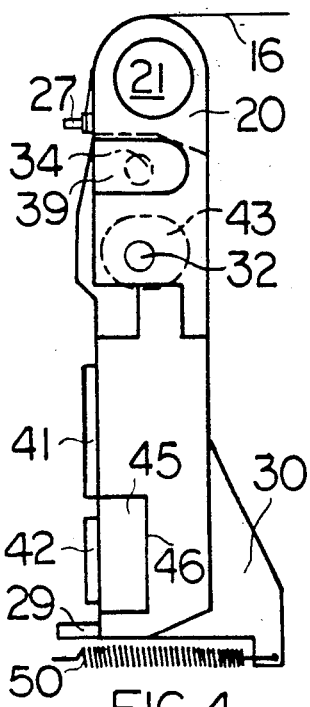
FIGS. 4, 5 and 6 demonstrate a string tension adjusting mechanism for a steel guitar of the prior art, illustrating, in FIG. 4 the mechanism in neutral position.
Figure 5:
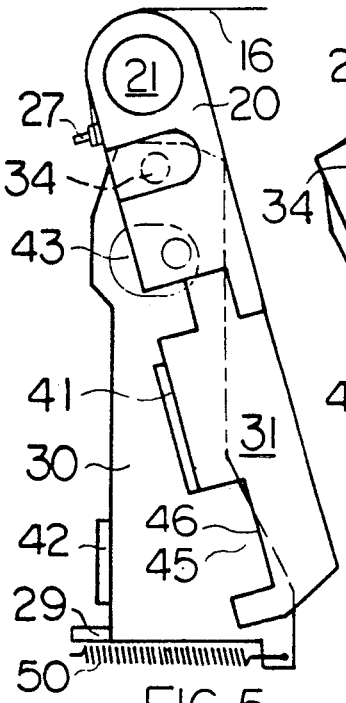
Figure 6:
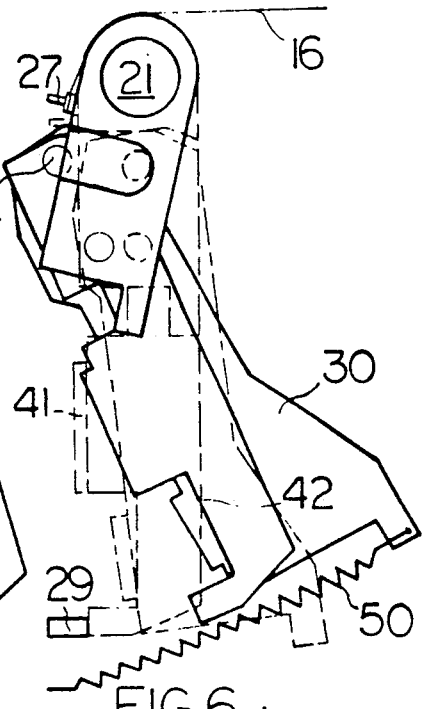
FIG 6 PRIOR ART

As previously noted, FIGS. 4, 5 and 6 illustrate the string tension adjusting mechanism described by Lashley in U.S. Pat. No. 4,175,467. Where possible, the numbers utilized by Lashley are utilized in these drawings so as to describe the relationship of the parts in both the raising and lowering of the pitch. The drawings have been made from the reverse side, since it was felt that the movement of the parts were better seen from that perspective. Accordingly, what Lashley refers to as clockwise in his description, will appear to be counterclockwise in this description and additionally, the counterclockwise designation of Lashley will appear to be clockwise, when viewed from the other side of the mechanism.

OPERATION

Figure 7:
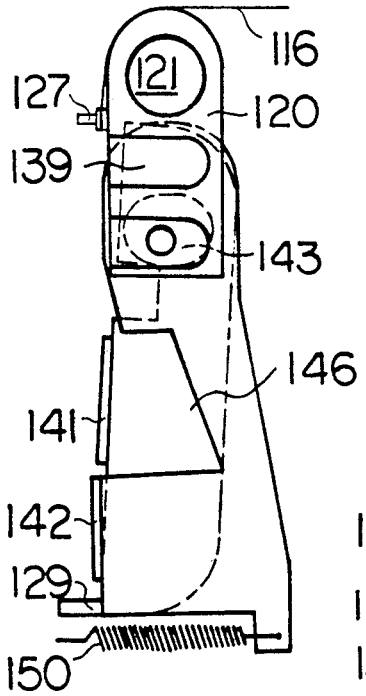
FIGS. 7, 8 and 9 illustrate, in a side elevational view, the same positions of the present invention, in the neutral position (FIG. 7); raised position (FIG. 8); and lowering position (FIG. 9).
Figure 8:
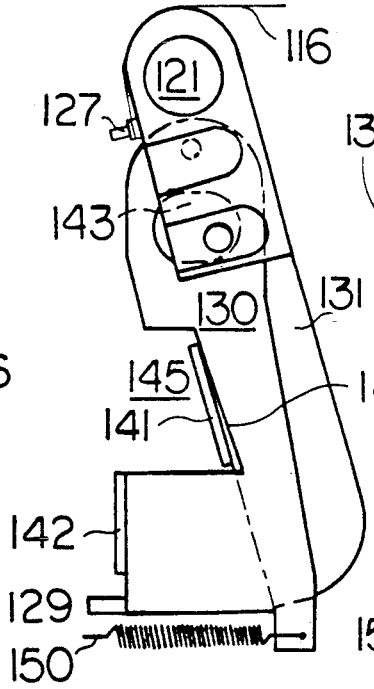
Figure 9:
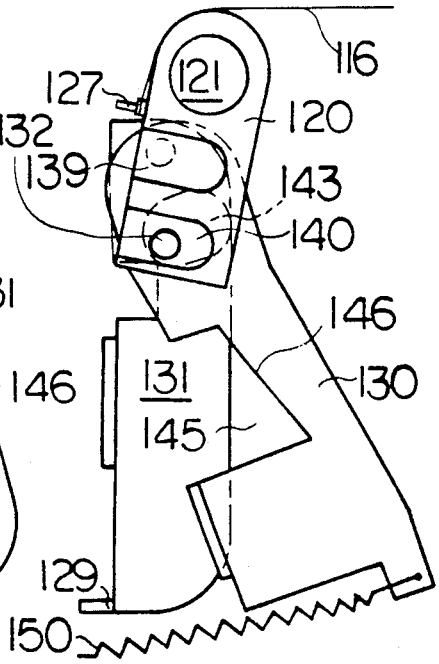

As has previously been mentioned, the string tension adjusting mechanism of Lashley is illustrated in FIGS. 4, 5 and 6, while the string tension adjusting mechanism of the present invention is illustrated in FIGS. 7, 8 and 9. FIGS. 4 and 7 illustrate the neutral position. FIGS. 5 and 8 illustrate the position for raising the pitch and FIGS. 6 and 9 illustrate the method of lowering the pitch. The method of raising the pitch appears to be fairly straightforward. As is shown in both FIGS. 5 and 8, as rods 22 and 122, respectively, pull the raising members 31 and 131 to the right, the bridge member 21 and 121 pivot counterclockwise, thus lowering the attachment pin 27 and 127, as is shown, to raise the tension on the string 16 and 116 and thus raise the pitch. However, there is a substantial difference in the method described by Lashley and the apparatus of the present invention in lowering the pitch and in moving the bridge member 20 and 120 in a clockwise direction, to release the tension on string 16 or 116 and thus lower the pitch.

Lashley describes the operation of the mechanism in Column 3, lines 22–35. He states that when rod 23 is pulled, the lowering member 30 pivots clockwise (counterclockwise in the drawing), causing the raising member 31 to rotate in a clockwise direction (counterclockwise in the drawing), causing securing bridge member 20 to pivot counterclockwise around bridge member axle 21, lowering the tension on the string 16. As is shown in FIG. 6, the lowering lever member 30 (shown in phantom lines) moves from the neutral position, bringing the bracket member 42 flush against the back wall 46 of notch 45 into engagement. Thereafter, further movement of lowering lever member 30 pulls the member 31 to rotate in a clockwise direction pivotably around axle 21, thus causing the bridge member 20 to pivot clockwise, thus lowering the tension on string 16. As previously mentioned, FIG. 6 is viewed from the opposite side, so that the directions are opposite, i.e. counterclockwise is clockwise, and as is shown, pin 27 does move to lower the tension on the string 16, thus lowering the pitch.

The point is that Lashley does involve engagement of the tone raising member 31 to lower the pitch and the tension on the string 16. In the present invention, on the other hand, movement of the lowering lever member 130 by actuating of the lowering rod 123, causes the bridge member 120 to rotate in a clockwise direction, thus lowering the tension on the string 16 and thus lowering the tone. The movement of the attachment pin 127 of the bridge 120 can be seen in comparison to the position in the neutral position in FIGS. 7 and 8. The reason this operates is because actuation of the pedal causes the lowering rod 123 to pull the lowering lever member 130 to the right (as illustrated) due to the release of tension on string 50 caused by the actuation of the foot pedal. In other words, the movement of the foot pedal and its associated lowering rod 123 by the muscles of the player's legs counteracts the biasing pressure of the spring 150 and allows the tension on string 116 to pull the attachment pin upwardly and pivot the bridge member 120 in a clockwise direction, thus lowering the tension on the string and lowering the tone. It is significant in this instance, that there is no movement whatsoever of the raising lever member 131, which remains rested against stop member 129.

According to this invention, therefore, each of the tone-changing lever members 130 and 131 act independently of the other and one does not move while the other is being actuated. Additionally, because of the spacer member 133, a free space is maintained between the lever members and between the lever member assembly and the bridge member 120. Therefore, friction and drag are minimized and a pure tonal quality is achieved, since the various members do not act to dampen the tone, one against the other.

Because of the preferred arrangement, in which the raising lever member 131 is located on the outside of the lowering lever member 130 and the rivet heads 136 and 132-A, respectively, extend to the outside edge of the raising lever member 131, it is is necessary to provide grooves 139 and 140, on the side surface of the depending leg of bridge member 121. Thus the rivet heads 136 and 132-A fit into these grooves and there is no contact, between one string tension adjusting mechanism assembly and an adjacent string tension adjusting mechanism.

Many modifications will occur to those skilled in the art from the description hereinabove given and such is meant to be illustrative and nonlimiting, except so as to be commensurate in scope with the appended claims.

I claim:

1. A string tension adjusting mechanism for a steel guitar, which comprises:

A. a bridge member, pivotably mounted on an axle adjacent to one end and resiliently biased into a normal operative position to tension to a desired pitch a string anchored to the said one end in use of the mechanism;

B. a raising lever member and a lowering lever member pivotably mounted to each other:

C. said lowering lever member having an enlarged hole below the point where the first and second lever members are pivotably mounted to each other;

D. a rivet member extending from said raising member through the enlarged hole of said lowering member and into operative relation with the body of said bridge member:

E. a spacer means mounted on said rivet member and occupying space within the circumscribed area of said hole, said spacer means maintaining a free space between said bridge member and said lowering member and a space between said lowering lever member and said raising lever member;

F. respective pull rods attached to said raising lever and said lowering lever, so that on pulling of each respective pull rod, said corresponding raising and lowering members create clockwise or counterclockwise rotation of said bridge member about the axle, thus raising or lowering the tension of the string trained across said bridge member to raise or lower the pitch;

G. a biasing spring attached to the lowering lever member.

2. A string tension adjusting mechanism, as defined in claim 1, in which said lowering lever member has a body and a depending leg, said body having a large V-shaped notch opening on its leading edge.

3. A string tension adjusting mechanism, as defined in claim 1, in which said raising and lowering lever members have depending legs, terminating in bracket members for attachment of said pull rod members.

4. A string tension adjusting mechanism, as defined in claim 1, which includes a stop for said lowering lever member for resiliently biasing against said spring attached to the terminal portion of said lowering lever member.

5. A multi-string steel guitar, in which each of said strings are tensioned to produce a desired tone, which can be raised by increase of the tension on said string and which can be lowered by a decrease of tension thereon, a string tension adjustment means, including:

A. a bridge member, pivotably mounted on an axle, to tension said string to a desired pitch;

B. a raising lever, to raise said pitch;

C. a lowering lever, to lower said pitch, said raising lever and lowering lever being pivotably mounted to each other;

D. one lever being pivotably mounted to said bridge member;

E. pull means attached to said raising and lowering lever members for actuating in raising and lowering said raising and lowering lever members: the improvement which comprises:

1. a large hole in one of said levers:
2. a spacer means, located in the area circumscribed by said hole and holding:
   a. said lowering and raising levers spaced from each other: and
   b. said bridge member in spaced relation from said lever members.

6. A multi-string steel guitar, as defined in claim 5, which includes:

A. a spring means, attached to said lowering lever member, to maintain biased tension on the spring.

7. A multi-string steel guitar, as defined in claim 5, in which said lowering lever member has a body and depending leg, said body having a large V-shaped notch opening on its leading edge.

* * * * *